US007109940B1

(12) United States Patent
Volman

(10) Patent No.: US 7,109,940 B1
(45) Date of Patent: Sep. 19, 2006

(54) ANTENNA ELEMENT WITH CURVED DIELECTRIC MEMBER AND ARRAY OF SUCH ELEMENTS

(75) Inventor: Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/910,904

(22) Filed: Aug. 4, 2004

(51) Int. Cl.
*H01Q 13/00* (2006.01)

(52) U.S. Cl. ..... 343/785

(58) Field of Classification Search ..... 343/785
See application file for complete search history.

(56) References Cited

U.S. PATENT DOCUMENTS 2,425,585 A * 8/1947 Wheller ..... 343/830
3,798,652 A * 3/1974 Williams ..... 343/708
3,858,214 A * 12/1974 Jones, Jr. ..... 342/362
4,053,897 A * 10/1977 Nerheim ..... 343/785
5,017,927 A 5/1991 Agrawal et al. ..... 342/371
5,115,244 A 5/1992 Freedman et al. ..... 342/158
5,196,857 A 3/1993 Chiappetta ..... 343/881
5,214,439 A 5/1993 Reed ..... 343/877
5,258,771 A 11/1993 Praba ..... 343/895
5,459,474 A 10/1995 Mattioli et al. ..... 343/702
5,757,323 A * 5/1998 Spencer ..... 343/700 MS
6,549,174 B1 * 4/2003 Kloefer et al. ..... 343/786

* cited by examiner

*Primary Examiner*—Tho Phan
(74) *Attorney, Agent, or Firm*—Duane Morris, LLP

(57) ABSTRACT

An antenna, which may be used as an element in an array, includes an elongated curved dielectric member having a high dielectric constant. One end of the dielectric member is in physical contact with the "center" conductor of an unbalanced transmission line, and projects above a ground plane. The dielectric member is roughly vertical at the feed point and horizontal at the distal end. The dielectric constant is greater than 10, preferably greater than about 80, and most preferably 120 or more.

16 Claims, 16 Drawing Sheets

SUBARRAY VIEW

ANTENNA ELEMENT WITH CURVED DIELECTRIC MEMBER AND ARRAY OF SUCH ELEMENTS

FIELD OF THE INVENTION

This invention relates to antennas, and more particularly to elemental antennas comprising dielectric members, and arrays thereof.

BACKGROUND OF THE INVENTION

Antennas are recognized as being transducers which transduce electromagnetic signals between the guided-wave form, in which the direction of propagation is controlled by a conductive or dielectric waveguide, and a free-space form, in which the propagation takes place in an unguided manner. Those skilled in the art know that many terms associated with antennas are used for historical reasons. For example, at a time at which reception of signals was accomplished only by the use of a long wire connected to the receiver, antenna coupling problems were experienced only when high power was involved, which was the case with transmitting antennas. These antenna coupling problems were discussed in terms of radiation of signals applied to a "feed" point or terminals of the antenna. Only later was it recognized that the radiation pattern and impedance characteristics of antennas were identical regardless of the direction of transduction, but by that time the "feed" terminology was firmly established. Thus, both transmitting and receiving antennas have "feed" points or terminals, and characteristics which are the same. Thus, descriptions of antenna operation may be couched in terms of transmission or reception modes, whichever provides the greater clarity in a given context, with the operation in the other mode being understood from the one description.

Antennas are widely used, to the extent that modern communication and sensing would be unrecognizable without their application. Many antenna types are known, including the long-wire Beverage antenna, the dipole and its monopole-over-ground-plane equivalent. The monopole and dipole antenna linear antennas have well-known radiation and impedance characteristics. Among the radiation pattern characteristics of monopole and dipole antennas are relatively limited bandwidth and relatively low gain, which tend to reduce their usefulness for demanding applications.

The art of arraying of elemental antennas such as monopoles and dipoles has long been used to ameliorate some of the disadvantages of linear antennas. Broadband arrays of dipoles and monopoles are known in the form of one-dimensional or line arrays, which tend to provide greater directivity than a single antenna element. Among the line arrays are log-periodic arrays, in which the dimensions of the constituent antenna elements vary in a monotonic manner along the length of the antenna. Log-periodic arrays, in addition to providing more directive gain than a single linear antenna, also have theoretically unlimited bandwidth. U.S. Pat. No. 5,196,857 issued Mar. 23, 1993 in the name of Chiappetta and U.S. Pat. No. 5,214,439 issued May 25, 1993 in the name of Reed describe log-periodic arrays. Another widely used type of array is the planar array, which is a two-dimensional arraying of elemental antennas. As ordinarily configured, such arrays can provide relatively high directivity in a direction orthogonal to the plane of the array. Those skilled in the art know that many different types of elemental antennas can be arrayed in two dimensions. For example, U.S. Pat. No. 5,258,771 issued Nov. 2, 1993 in the name of Praba describes a two-dimensional array of elemental helix antennas.

For some uses, two-dimensional arrays of antenna elements may include hundreds or even thousands of elemental antennas. The use of elemental antennas in an array may require a transmit-receive "feed" module for each elemental antenna. One arrangement for implementing transmit-receive feed modules for a two-dimensional array of elemental antennas is described in U.S. Pat. No. 5,017,927, issued May 21, 1991 in the name of Agrawal et al. Another feed arrangement for implementation of a two-dimensional antenna array is described in U.S. Pat. No. 5,115,244, issued May 19, 1992 in the name of Freedman et al. Regardless of the type of feed, cost considerations become important when considering arrays of more than a few elements. The cost of the elemental antennas is of more than passing interest when large numbers of elements are to be used. In addition, the complexity of the mounting arrangements for each elemental antenna must be considered. U.S. Pat. No. 5,459,474, issued Oct. 17, 1995 in the name of Mattioli et al. describes an array antenna in which the elemental radiating antennas are horns, and the feed arrangement for each elemental horn includes a movable feed element which is inserted from the rear into the horn.

Simple and or low-cost antennas are desired, especially those which are convenient to array.

SUMMARY OF THE INVENTION

An antenna according to an aspect of the invention comprises an unbalanced transmission-line feed defining center and outer conductors. An elongated dielectric or nonconductive member defines first and second ends, and is curved between the first and second ends. The curvature in one embodiment is about 90°. The first end of the dielectric member is connected to the center conductor of the unbalanced transmission-line. According to an aspect of the invention, the dielectric constant of the dielectric member exceeds 10, and preferably exceeds about 80. In one embodiment, the dielectric constant is 120.

An antenna according to another aspect of the invention includes a ground plane defining an aperture with a periphery, and an unbalanced transmission line including an outer conductor coupled to the periphery, and also including a center conductor. An elongated dielectric member defines first and second ends, and is curved between the first and second ends. The dielectric member is mounted with the first end of the dielectric member in contact with the center conductor, and with at least one of (a) a tangent to an axial centerline the dielectric member adjacent the first end projecting generally orthogonally to the local surface of the ground plane and (b) a tangent to an axial centerline of the dielectric member adjacent the second end of the dielectric member generally parallel with the local surface of the ground plane. In one embodiment, the dielectric member is a dielectric rod, which may have a generally circular cross-section orthogonal to the axial centerline of the dielectric member. According to an aspect of the invention, the dielectric constant of the dielectric member is greater than 10. The dielectric constant is preferably greater than about 80, and in one embodiment the dielectric constant of the dielectric member is near 120.

According to another aspect of the invention, electrically conductive-material is applied to a dorsal portion of the exterior surface of the dielectric member. This electrically conductive material may be in galvanic contact with the center conductor.

According to another aspect of the invention, an array antenna comprises a ground plane and first and second elemental antennas, each of which elemental antennas comprises an unbalanced transmission line including an outer conductor coupled to the periphery of an aperture in the ground plane, and also comprises a center conductor. Each of the elemental antennas also includes an elongated dielectric member defining first and second ends, with the dielectric member being curved between the first and second ends. Each elemental antenna also has the dielectric member mounted with the first end of the dielectric member in contact with the center conductor, and with one of (a) a tangent to an axial centerline the dielectric member adjacent the first end projecting generally orthogonally to the local surface of the ground plane and (b) a tangent to an axial centerline of the dielectric member adjacent the second end generally parallel with the local surface of the ground plane. According to one version of this aspect of the invention, the dielectric constant of the dielectric member of each of the elemental antennas is greater than 10. According to another version, the dielectric constant of the dielectric member of each of the elemental antennas is greater than about 80, and preferably near 120. In another aspect of the invention, the dielectric constants of the dielectric members of the elemental antennas are approximately equal.

DESCRIPTION OF THE INVENTION

Figure 1A:
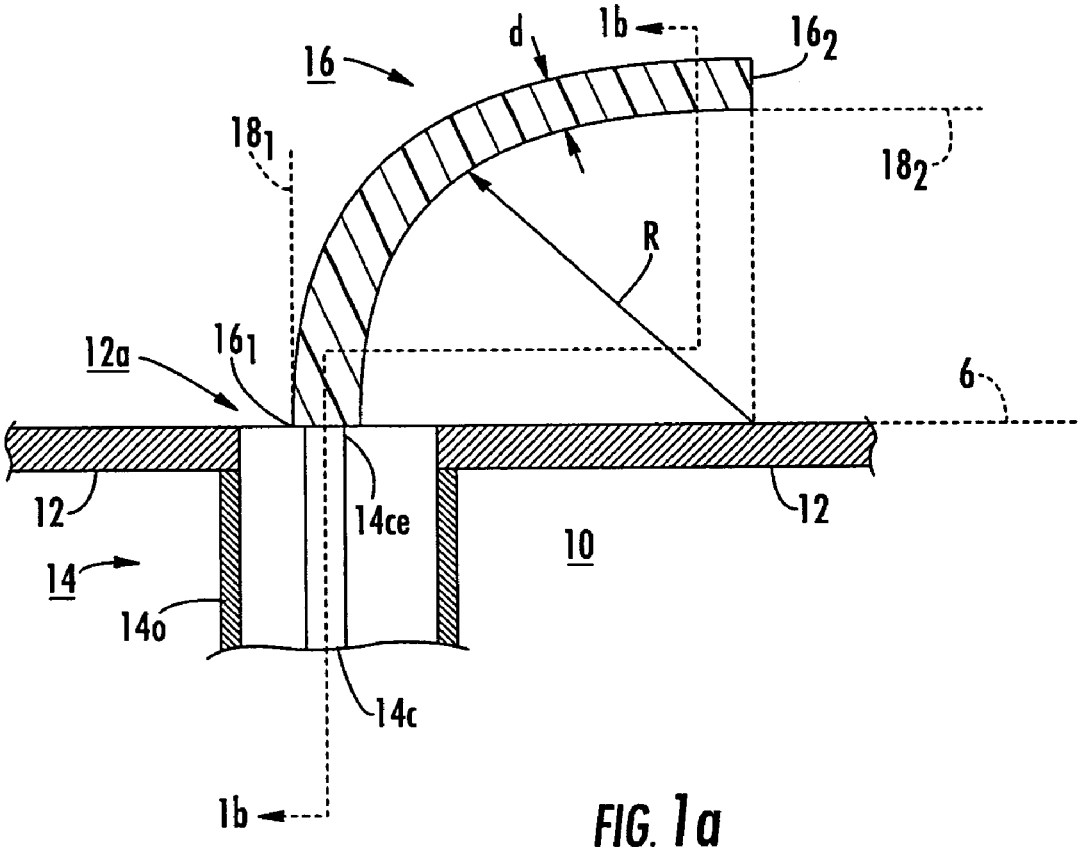
FIG. 1*a* is a simplified side elevation cross-sectional view of an antenna element according to an aspect of the invention.

In FIG. 1*a*, an antenna element designated generally as 10 includes an electrically conductive ground plane 12 defining a through aperture 12*a*. Those skilled in the art know that a ground "plane" has finite dimensions, and therefore is not strictly speaking planar. Nevertheless, the plane of the ground plane 12 is designated 6. A portion of an unbalanced electromagnetic transmission line designated generally as 14 includes an electrically conductive outer conductor 14*o* and an electrically conductive center conductor 14*c*. A "transmission line" generally means a guiding arrangement for guiding electromagnetic fields from one location to another; the term ordinarily connotes guiding with low loss, which in turn suggests relatively low resistive or heat losses and relatively constant surge or characteristic impedance. Transmission line 14 of FIG. 1*a* or 1*b* may be a conventional "coaxial" transmission line, either flexible, semi-rigid or rigid. Outer conductor 14*o* is coupled to the edges of aperture 12*a*, as by soldering or fusion welding. The connection may also be made by the use of any conductive filler, such as adhesive loaded with conductor. One useful type of conductive filler is silver-loaded epoxy. The space between the center conductor 14*c* and the outer conductor 14*o* of transmission line 14 can be expected to contain a support structure for holding the center conductor, but the simplification of FIGS. 1*a* and 1*b* deletes this structure. Those skilled in the art know that a suitable support structure may include a plastic or foamed-plastic fill, or a helically disposed or other plastic support.

Figure 1B:
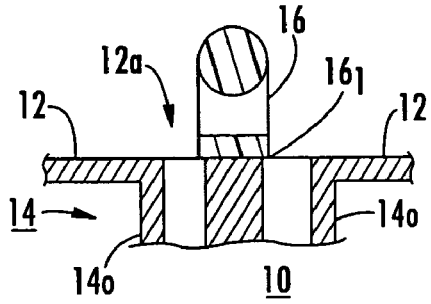
FIG. 1*b* is a simplified cross-sectional view of the antenna of FIG. 1*a* looking in the direction of section lines b—b.

Center conductor 14*c* of transmission line 14 extends conventionally through the outer conductor 14*o*, and terminates at or near the plane 6 of the ground plane 12. According to an aspect of the invention, a dielectric element, designated 16 in FIGS. 1*a* and 1*b*, is physically connected to that end 14*ce* of center conductor 14*c* which terminates at the plane 6 of the ground plane 12. For simplicity of discussion, the dielectric element of FIGS. 1*a* and 1*b* are termed "monopole" or "dipole." According to another aspect of the invention, the dielectric constant or epsilon ($\epsilon$) of the dielectric element, relative to vacuum, is large. In one embodiment, the value $\epsilon$ is in the vicinity of 120.

Dielectric rod antennas are known. In general, such dielectric rod antennas have relatively low dielectric constants, as less than $\epsilon$=10, so that the transducing or transduction of electromagnetic waves between free space and the dielectric rod is accomplished without excessive reflection at the transition. In some cases, the dielectric rod is tapered in such a fashion that it has relatively small dimensions near the transition to free space and larger dimensions adjacent the guided-wave end of the rod, as another way to aid in reducing reflections.

As illustrated in FIGS. 1*a* and 1*b*, dielectric member 16 is elongated, and defines a first end $\mathbf{16}_1$ adjacent end 14*ce* of center conductor 14*c* and a second end $\mathbf{16}_2$ remote from end 14*ce*. Elongated dielectric member 16 as illustrated in FIG.

1*a* is also curved in the region between ends $16_1$ and $16_2$, and has a radius of curvature designated R. More particularly, a tangent $18_1$ to elongated dielectric member 16 at a location adjacent end $16_1$ is approximately orthogonal to the plane 6 of ground plane 12. A tangent $18_2$ to elongated dielectric member 16 at a location adjacent end $16_2$ is approximately parallel with plane 6. In regions between ends $16_1$ and $16_2$, dielectric member 16 makes a gentle curve.

The termination of a transmission line, such as transmission line 14 of FIGS. 1*a* and 1*b*, in a dielectric member for use as an antenna for radiating in the far field is not conventional. In operation, the high dielectric constant of the dielectric member 16 reduces the electric fields within the member 16 much as occurs due to electrical conduction in an electrical conductor. The dielectric member 16 carries a "displacement" current, known in the capacitor arts, which coacts with ground plane currents to produce the conditions necessary for radiation to the far field. In this context, the "far" field may be viewed as being at an infinite distance from the radiating source, while the "near" field relates to effects which are as a practical matter limited to the region in the immediate vicinity of the source. The far field is sometimes said to begin at a distance from the source which is given by $2D^2/\lambda$, where D is a characteristic dimension of the source and $\lambda$ is the radiated wavelength.

Figure 2:
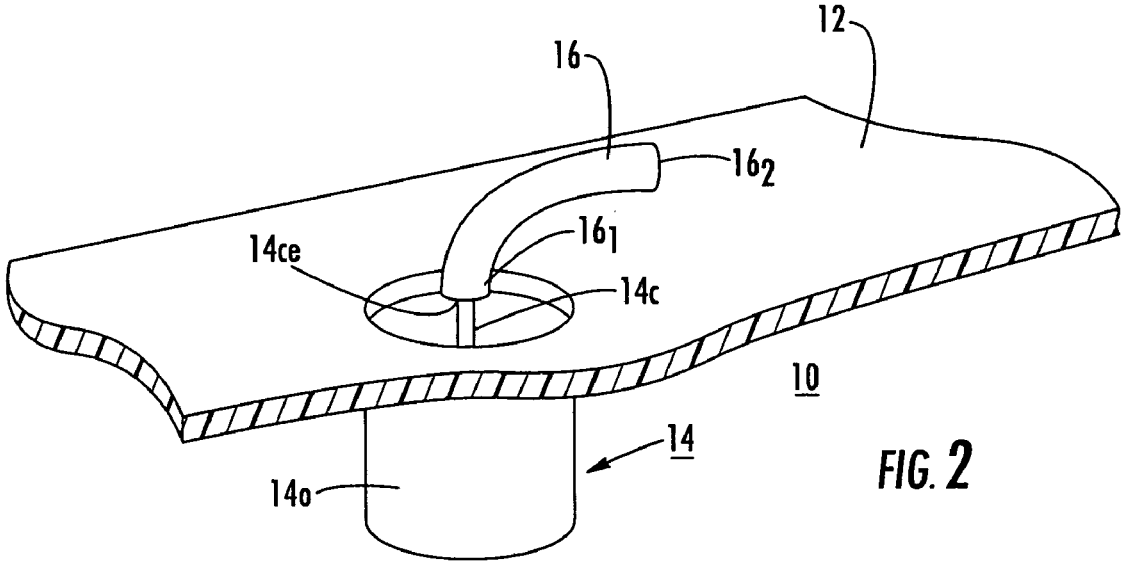
FIG. 2 is a simplified perspective or isometric view of the antenna of FIG. 1*a* with a portion of its ground plane.

FIG. 2 is a simplified perspective or isometric view of the structure illustrated in FIGS. 1*a* and 1*b*. Elements of FIG. 2 corresponding to those of FIGS. 1*a* and 1*b* are designated by the same reference alphanumeric or numeral.

In a particularly advantageous embodiment of the antenna element of FIGS. 1*a* and 1*b* for use at frequencies between about 0.5 GHz to about 12 GHz (corresponding to $\lambda_{max}$=600 mm to $\lambda_{min}$=25 mm), transmission line 14 has a characteristic impedance of 50 ohms, the dielectric member is a rod having a diameter d of 5.4 mm, corresponding to 0.06 $\lambda_{max}$, a radius R of 18.9 mm, and a height H of end $16_2$ above the ground plane 12 of 21.6 mm (corresponding to 0.036 $\lambda_{max}$. The dielectric rod in this embodiment has $\epsilon_R$ of 120.

Figure 3:
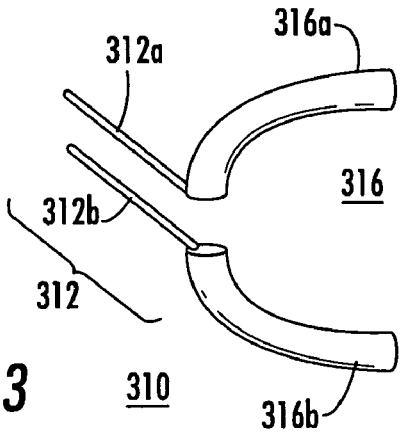
FIG. 3 is a simplified perspective or isometric view of a balanced antenna using elements such as that illustrated in FIGS. 1*a* and 1*b;*

FIG. 3 is a simplified perspective or isometric view of a symmetrical or balanced transmission line feeding a balanced dielectric antenna according to another aspect of the invention. In FIG. 3, a balanced antenna designated generally as 310 is fed by a balanced transmission line 312 in the form of a two-wire line including mutually parallel conductors 312*a* and 312*b*. A pair of high-$\epsilon$ dielectric members 316*a* and 316*b* together make or constitute a balanced radiator 316. It will be apparent that dielectric member 316*b* is a mirror-image of member 316*a* about a plane (not illustrated) lying between the members. This embodiment is used for computer simulation at certain frequencies of the antenna according to an aspect of the invention, because the size of the ground plane for the embodiment of FIGS. 1 and 2 may be beyond the capabilities of the simulation. It should be noted that while the two antenna elements 316*a*, 316*b* of FIG. 3 are as a pair connected to a balanced transmission line, each one individually is connected to what amounts to the main conductor of an unbalanced transmission line over ground. Balanced antennas fed by balanced transmission lines are quite practical, as well as being useful for calculation.

Figure 4A:
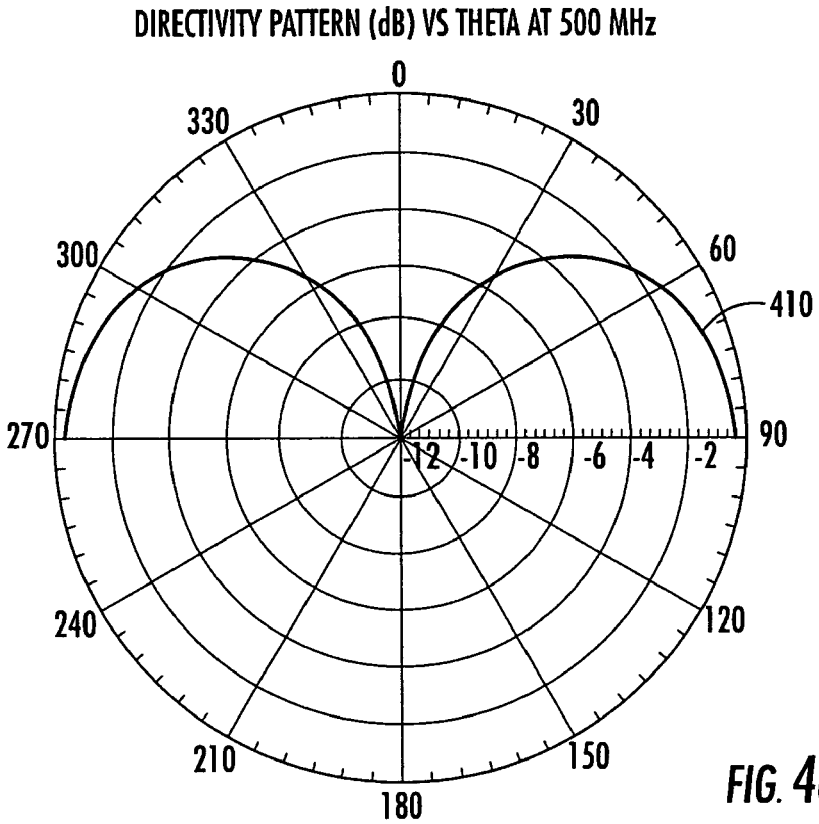
FIG. 4*a* is a calculated elevation directivity pattern in dB for the antenna of FIGS. 1*a* and 1*b* at 500 MHz for three different azimuth angles.
Figure 4B:
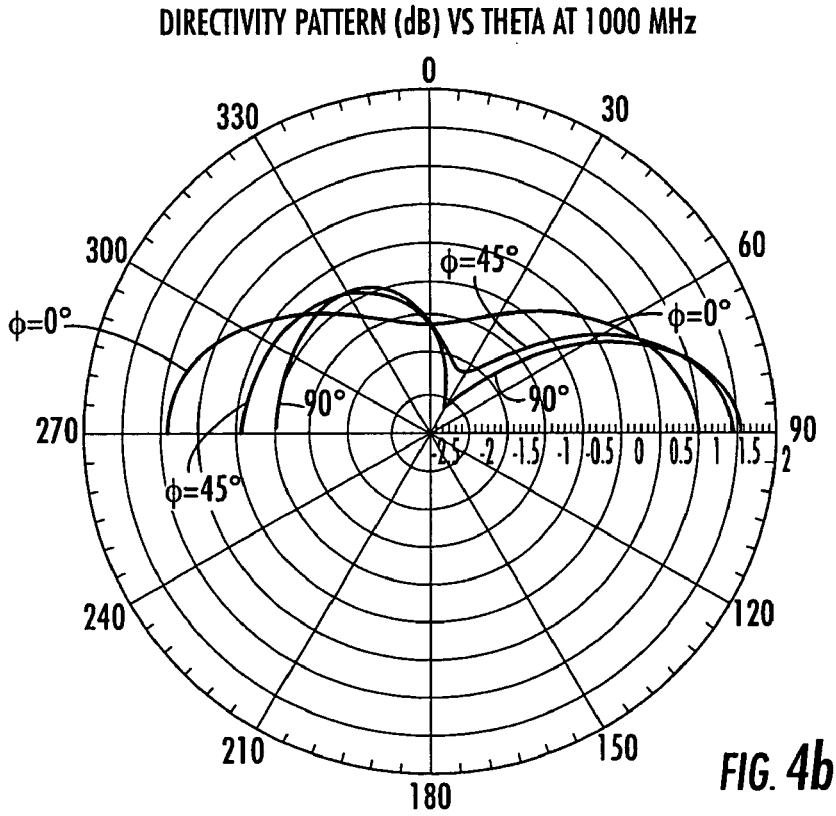
FIG. 4*b* is a calculated elevation directivity pattern in dB for the antenna of FIGS. 1*a* and 1*b* at 1000 MHz for three different azimuth angles.
Figure 4C:
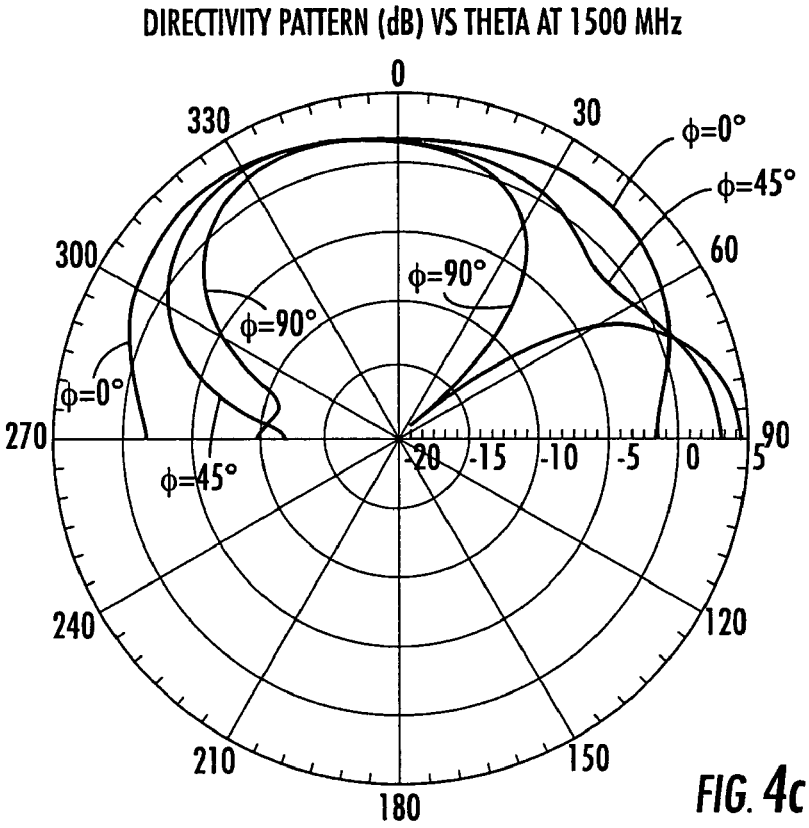
FIG. 4*c* is a calculated elevation directivity pattern in dB for the antenna of FIGS. 1*a* and 1*b* at 1500 MHz for three different azimuth angles.
Figure 4D:
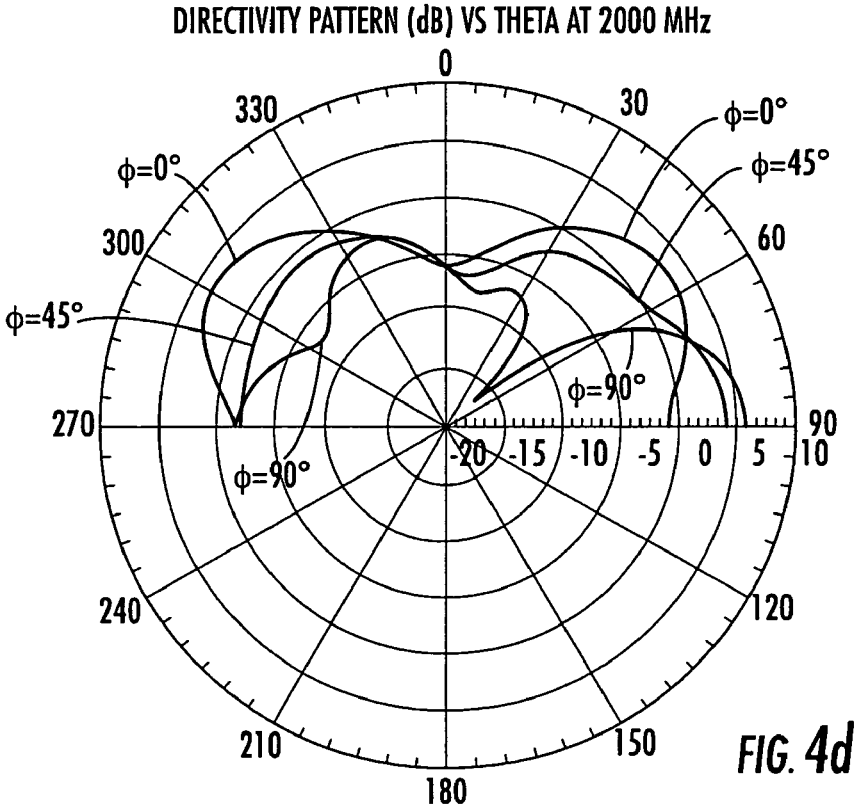
FIG. 4*d* is a calculated elevation directivity pattern in dB for the antenna of FIGS. 1*a* and 1*b* at 2000 MHz for three different azimuth angles.
Figure 4E:
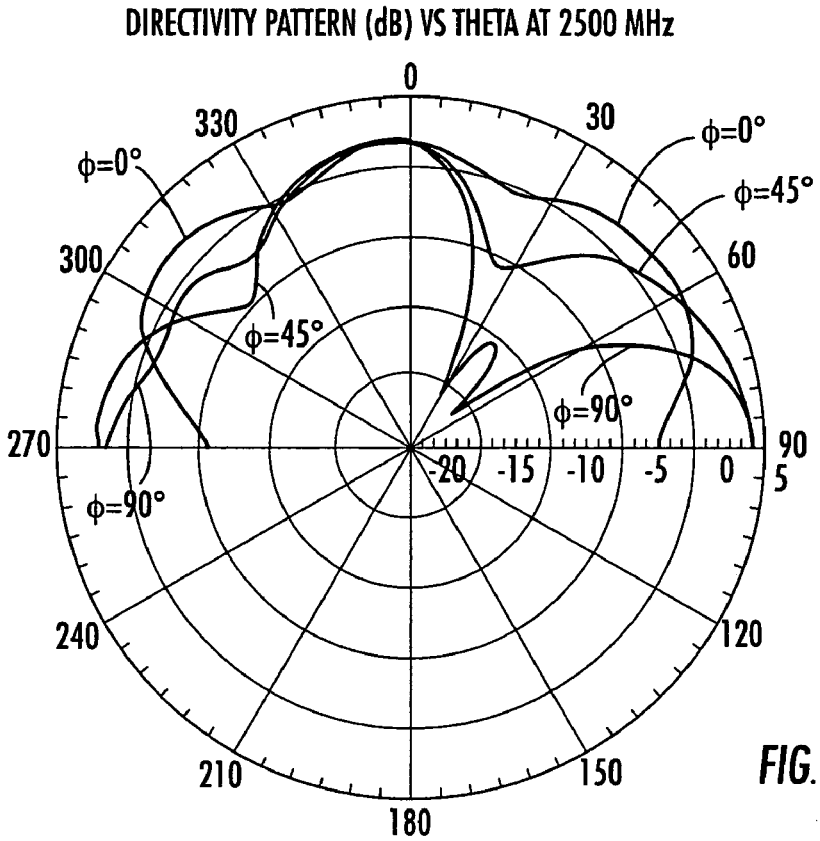
FIG. 4*e* is a calculated elevation directivity pattern in dB for the antenna of FIGS. 1*a* and 1*b* at 2500 MHz for three different azimuth angles.
Figure 4F:
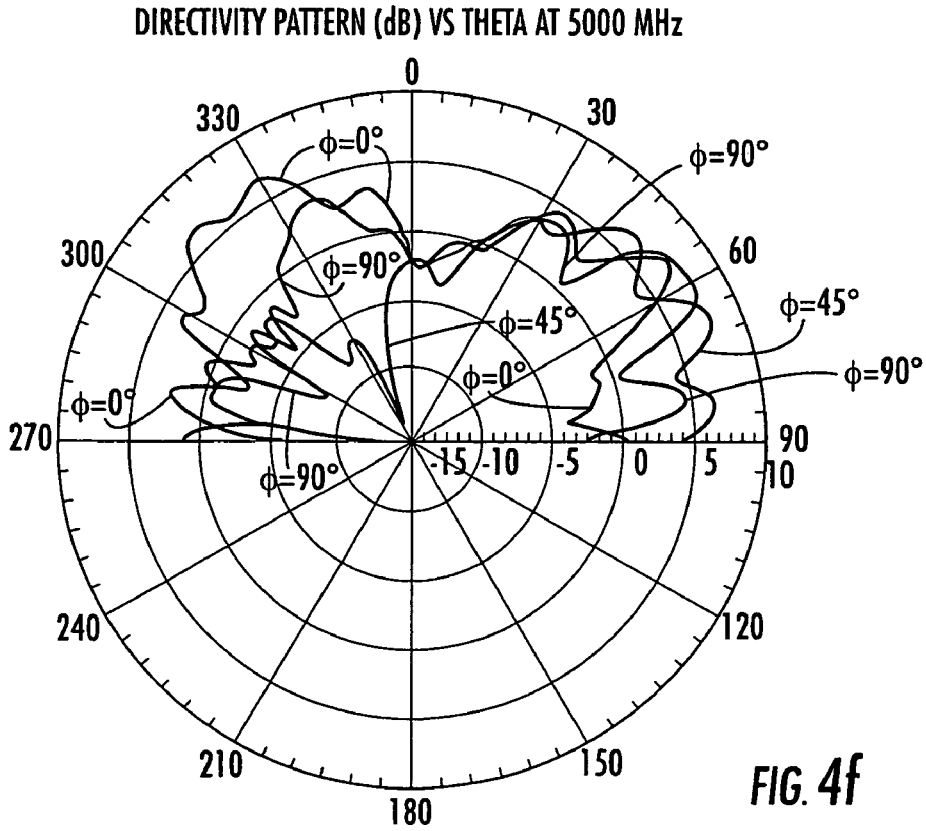
FIG. 4*f* is a calculated elevation directivity pattern in dB for the antenna of FIGS. 1*a* and 1*b* at 5000 MHz for three different azimuth angles.
Figure 4G:
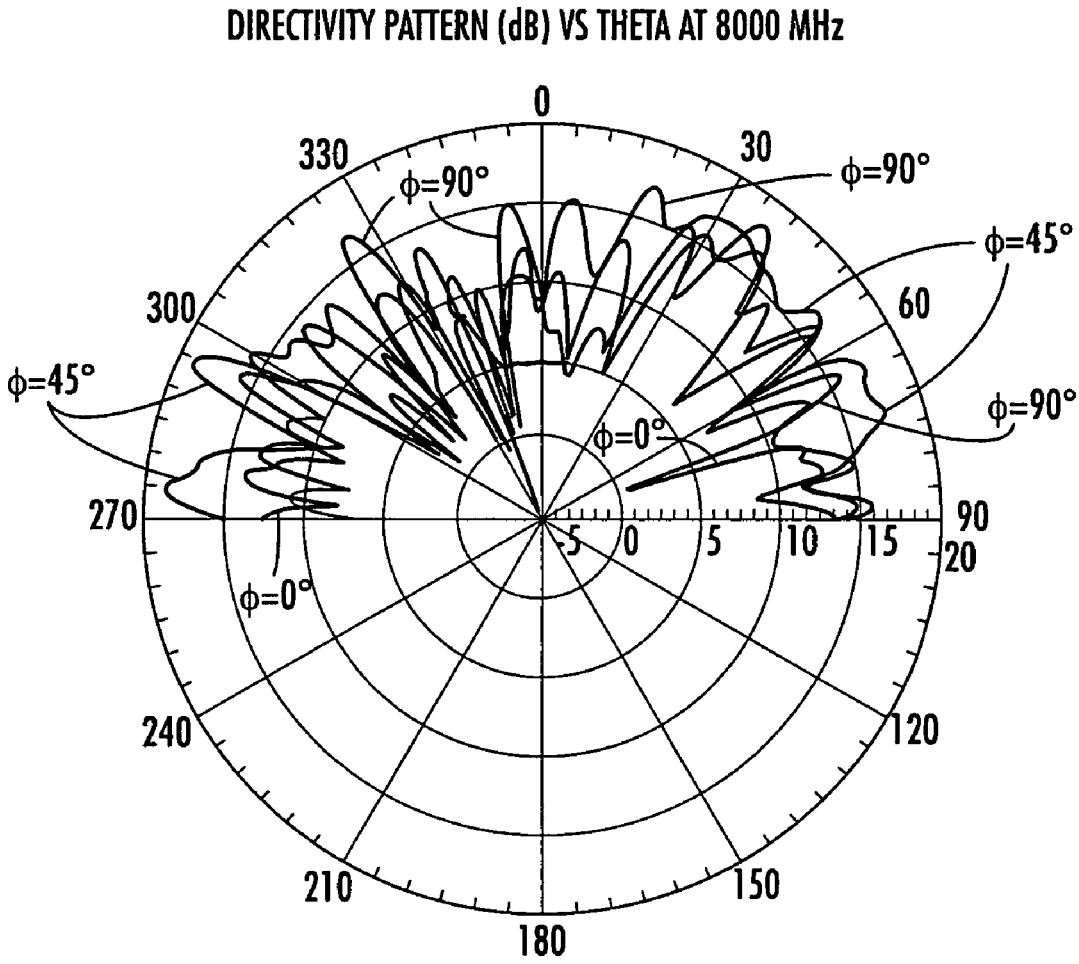
FIG. 4*g* is a calculated elevation directivity pattern in dB for the antenna of FIGS. 1*a* and 1*b* at 8000 MHz for three different azimuth angles.

FIGS. 4*a*, 4*b*, 4*c*, 4*d*, 4*e*, 4*f*, and 4*g* are directivity plots in dB versus zenith angle θ for the antenna of FIGS. 1 and 2 with the stated dimensions at 500, 1000, 1500, 2000, 2500, and 8000 GHz, respectively, for three different values of azimuth angle ø, namely ø=0°, 45°, and 90°. In FIG. 4*a*, the ø=0°, 45°, and 90° plots are superposed to form a single plot 410 at 500 MHz, and are not separately visible. The FIG. 4*a* plots are equivalent to those of a conventional metallic or electrically conductive monopole. FIG. 4*b* represents the performance of the dielectric antenna at 1000 MHz. In FIG. 4*b*, the performance is similar at ø=45° and 90°, and somewhat different at ø=0°. FIG. 4*c* illustrates the directivity patterns at 1500 MHz, FIG. 4*d* at 2000 MHz, FIG. 4*e* at 2500 MHz, FIG. 4*f* at 5000 MHz, and FIG. 4*g* at 8000 MHz.

Figure 5:
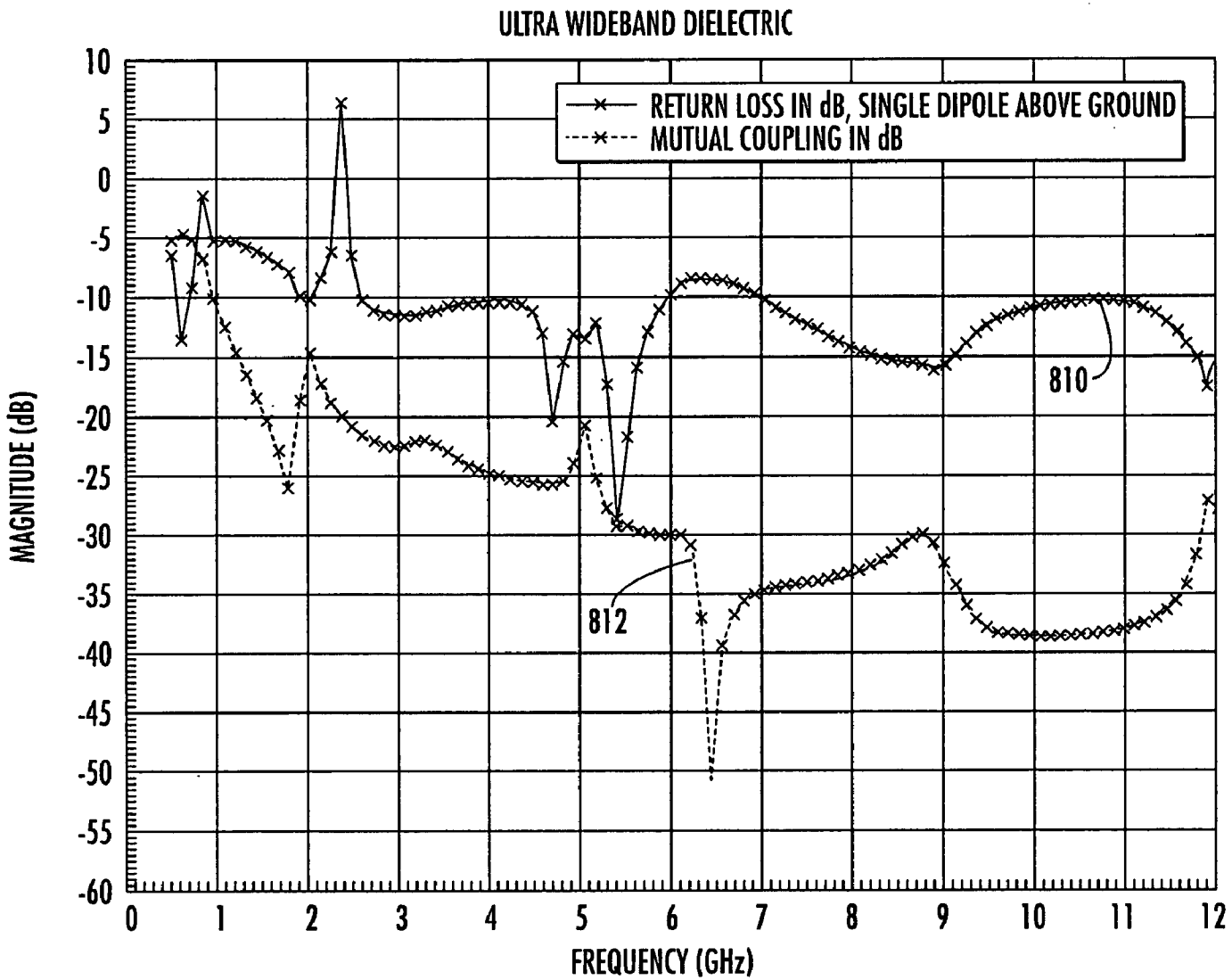
FIG. 5 is a calculated return loss plot in dB of the antenna of FIGS. 1*a* and 1*b* over the frequency range of 500 MHz to 8 GHz.

FIG. 5 illustrates a plot of the return loss in dB of the antenna of FIGS. 1 and 2 with the abovementioned dimensions and a relative dielectric constant of about 80, over the frequency range of 500 MHz to 8000 MHz. It can be seen that the return loss is better or lower than (more loss than) 10 dB over the frequency range of about 2 GHz to 8 GHz, and is generally lower than 4 dB. The plot shows a peak of about 3 dB near 2.5 GHz.

Figure 6A:
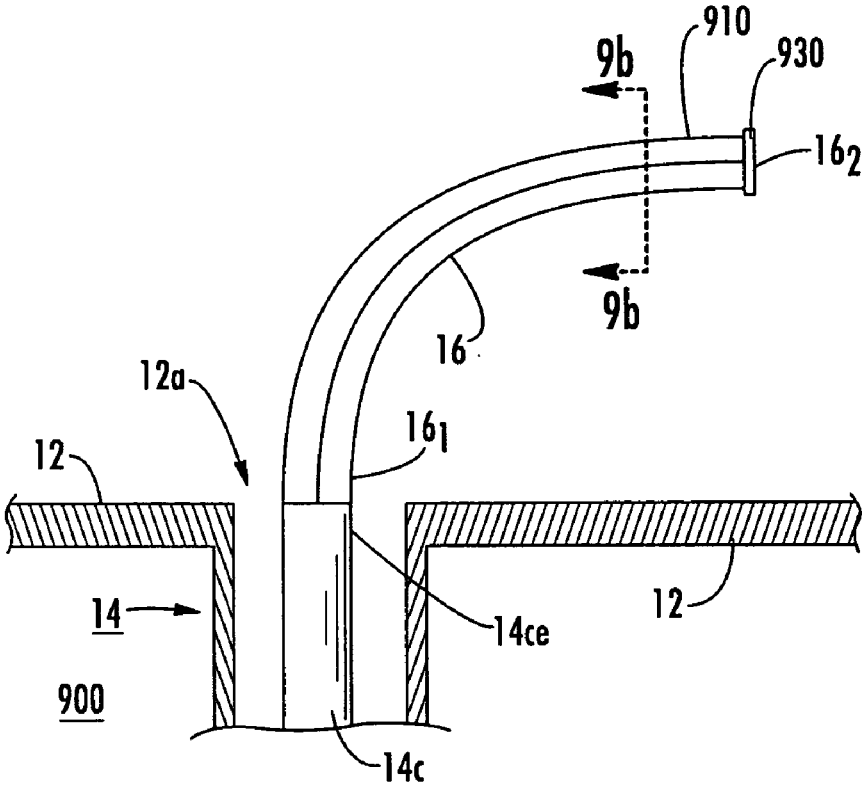
FIGS. 6*a* and 6*b* are simplified, partially sectioned side elevation and end views, respectively, corresponding generally to those of FIGS. 1*a* and 1*b*, of another embodiment of the invention.
Figure 6B:
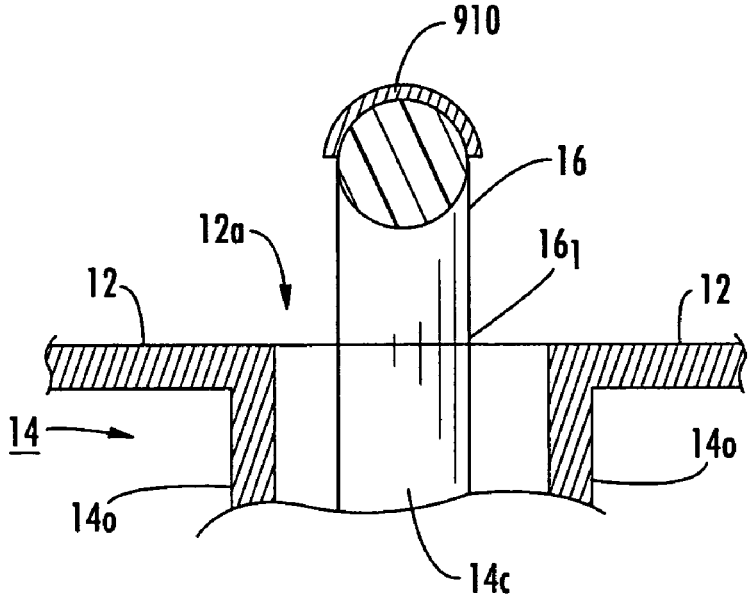
Figure 6C:
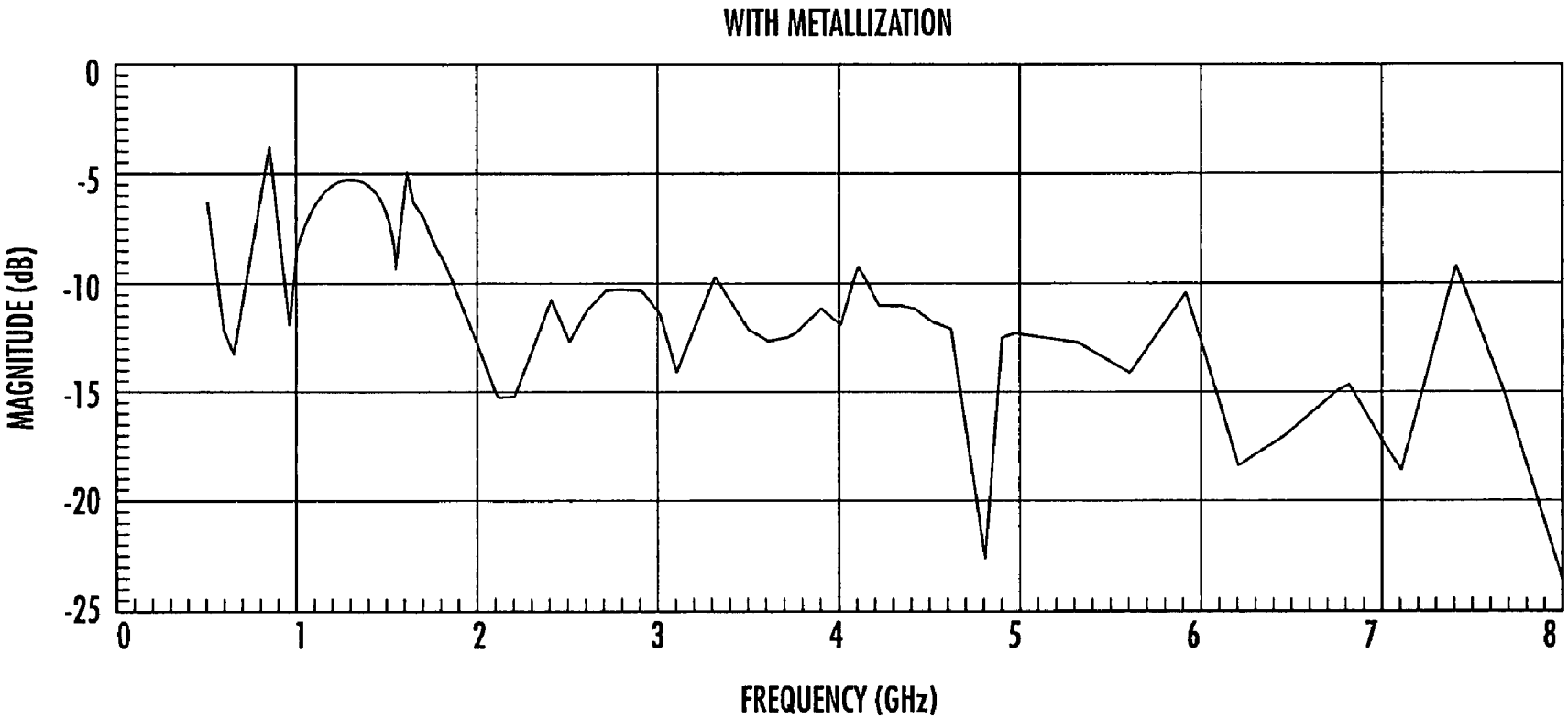
FIG. 6*c* is a plot of return loss of the antenna of FIGS. 6*a* and 6*b* over the frequency range of 500 MHz to 8 GHz.

It has been discovered that slightly better performance can be achieved if the dielectric element of the antenna according to the invention is provided with some metallization. This slightly better performance is manifested as somewhat improved return loss over the frequency range of 0.5 to 8 GHz, as can be seen by comparing the plot of FIG. 6*c* with the plot of FIG. 5. FIG. 6*a* illustrates in side, partially sectioned view an antenna similar to that of FIG. 1*a*, but having an electrically conductive or metallic material 910 applied over a portion of the exterior of the dielectric monopole element 16. As illustrated in FIG. 6*b*, this conductive material 910 is disposed on the dorsal portion of the exterior of the dielectric monopole, and extends to the distal end $16_2$ of the monopole. At the feed end $16_1$ of the monopole element, the metallic coating or surface 910 is in electrical contact with the end 14*ce* of center conductor 14*c* of unbalanced transmission line 14.

Figure 7:
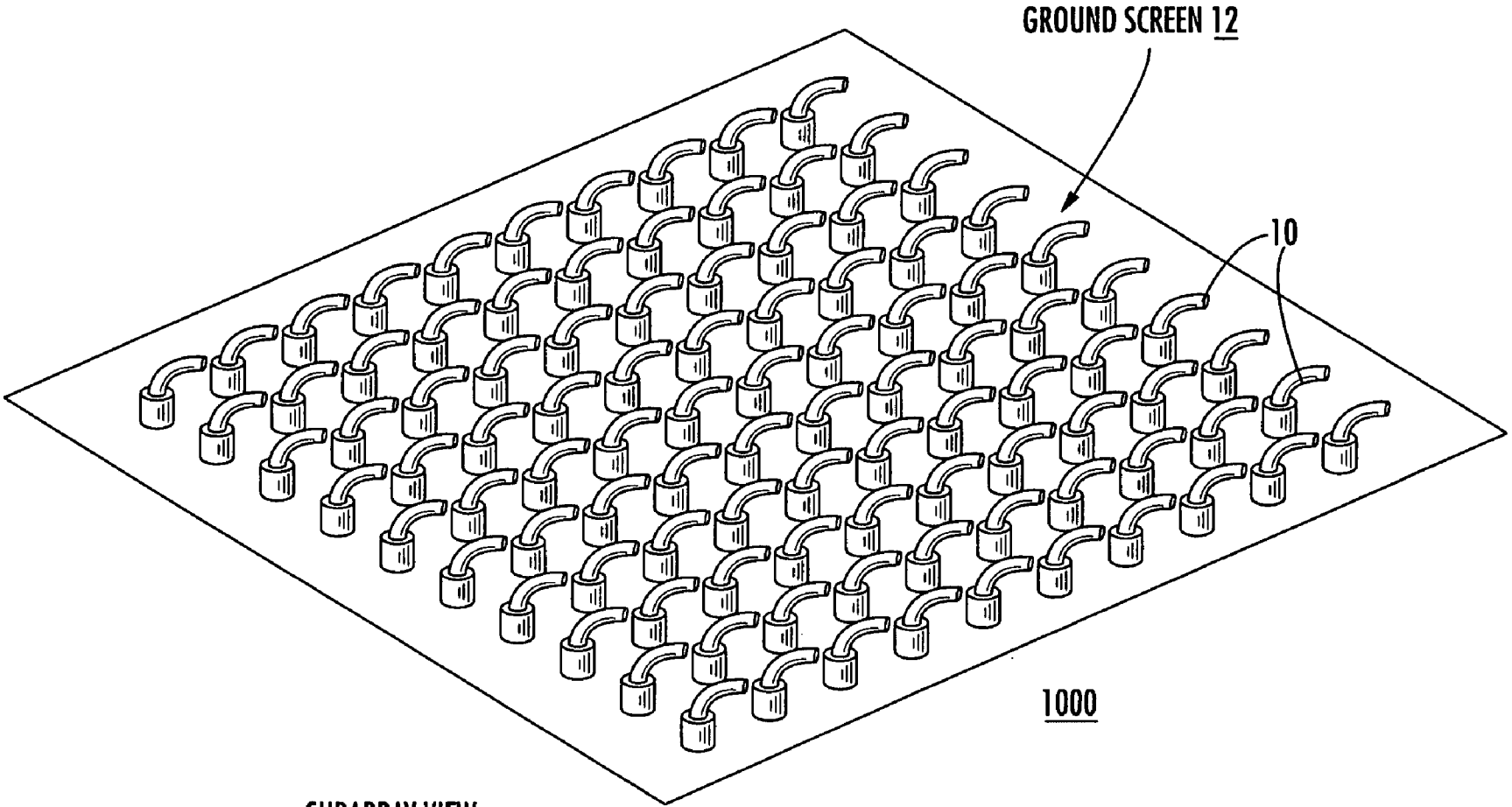
FIG. 7 is a simplified perspective or isometric view of an array or subarray of antenna elements such as those of FIG. 1*a*, 1*b*, or 6*a*, 6*b;*

FIG. 7 is a simplified perspective or isometric representation of a planar 10×10 array or subarray 1000 according to an aspect of the invention, in which a plurality of antennas 10 or 900 such as those of FIG. 1*a*, 1*b*, 2 or 6*a*, 6*b* are the elements. While the illustrated array 1000 is on a regular grid, the grid may be irregular. Also, the array or subarray 1000 may have any peripheral configuration, such as elliptical, circular, polyhedral, or rectangular. Those skilled in the art know how to use a beamformer to interconnect the elements of the array to produce array beam(s) in the desired directions).

Figure 8:
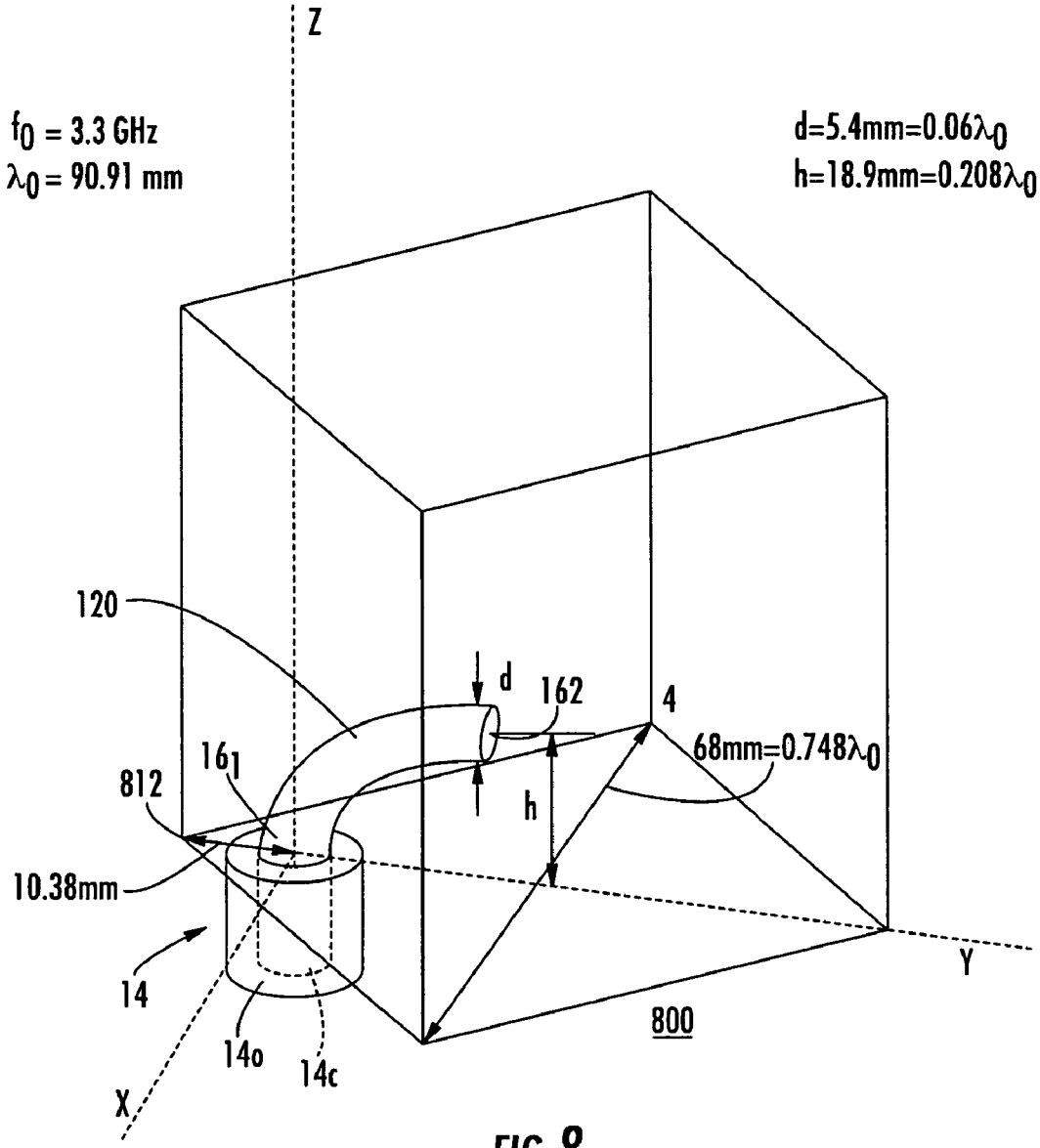
FIG. 8 is a simplified view of an array cell of FIG. 7, showing x, y, and z axes, and also showing the location of an elemental antenna of FIG. 1*a*, 1*b*, or 6*a*, 6*b* within the array cell.

FIG. 8 is a simplified perspective or isometric view illustrating parameters of the array cell 800 for the arrangement of FIG. 7 for operation at or near 3.3 GHz (free-space wavelength $\lambda$=90.91 mm). In FIG. 8, the diameter d of the curved dielectric monopole is 5.4 mm, corresponding to 0.06$\lambda$. The height h of the distal end of the dielectric monopole in FIG. 8 is 18.9 mm, corresponding to 0.208$\lambda$. The dielectric monopole has a relative dielectric constant of 120, and is fed by a 50-ohm coaxial transmission line. The feed point for the dielectric monopole is at the origin of the xyz cell 800 coordinate system of FIG. 8. The center of the feed center conductor 14 (corresponding to the location of the feed point 16, of the dielectric monopole) is located 10.38 mm in the +y direction from a corner 812 of the cell. The array cell is a square 68 mm (0.748$\lambda$) on a side.

Figure 9A:
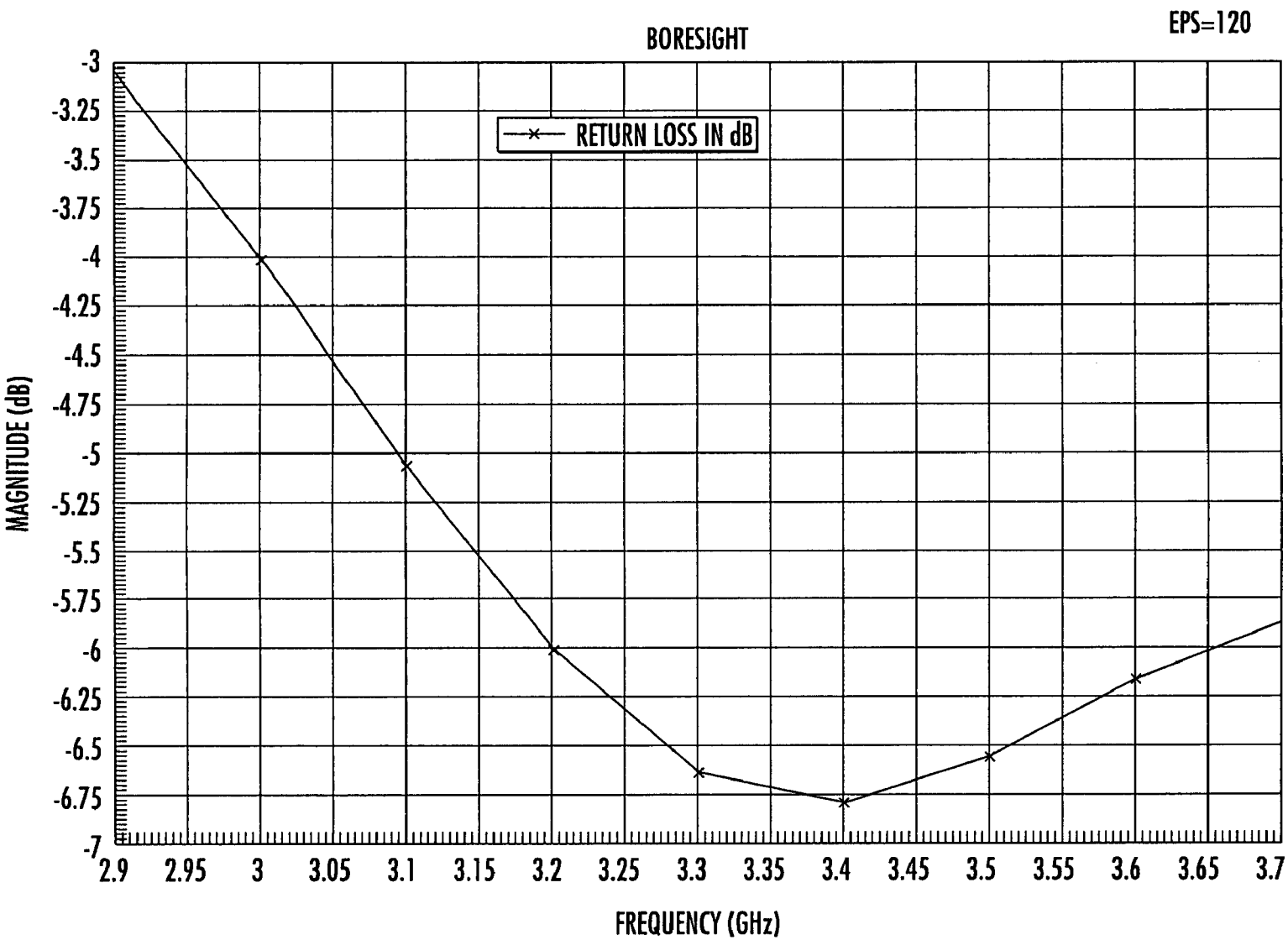
FIGS. 9*a*, 9*b*, 9*c*, 9*d*, and 9*e* illustrate return loss plots as a function of frequency for the array of FIGS. 7 and 8 at various beam directions.
Figure 9B:
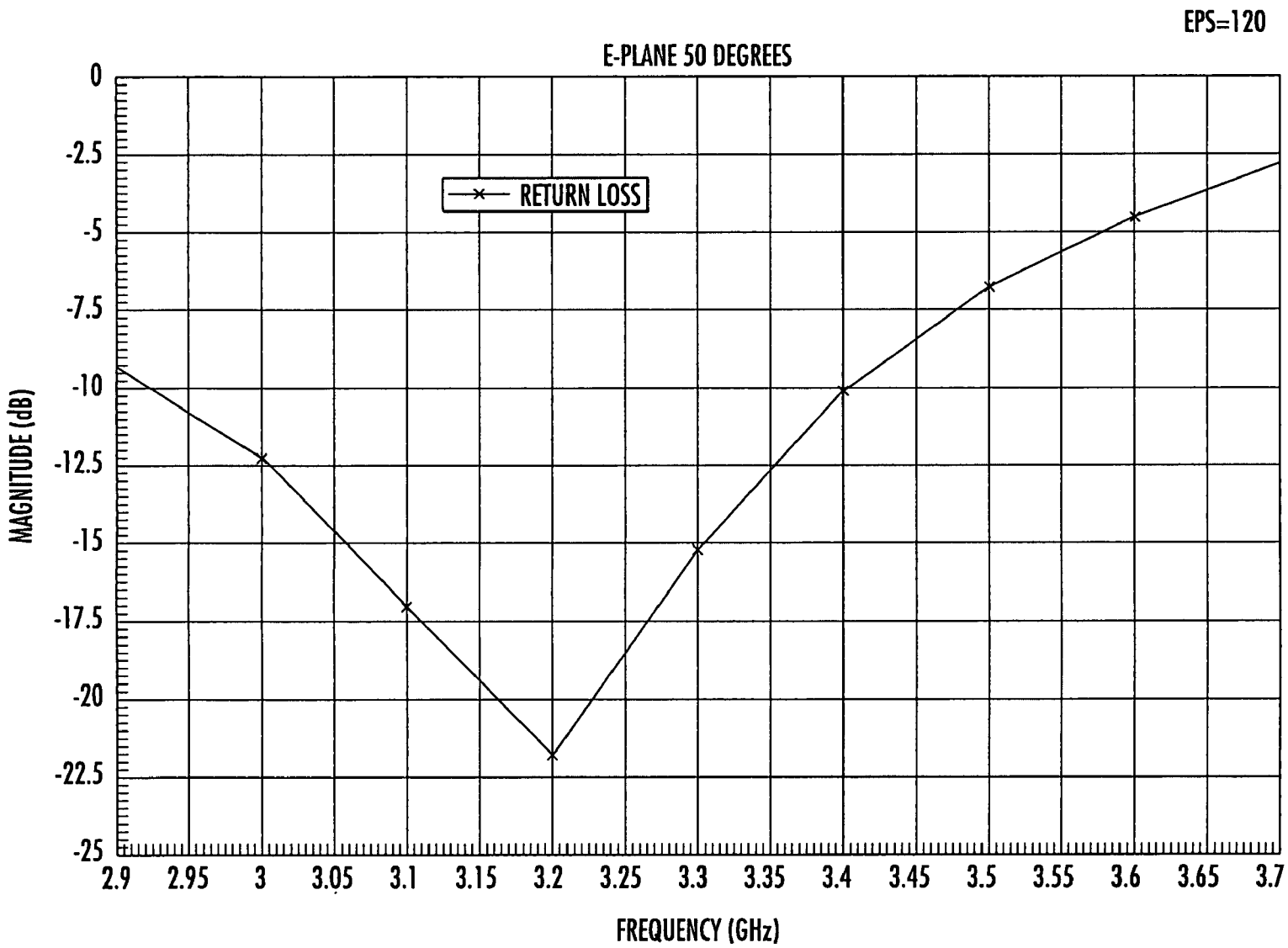
Figure 9C:
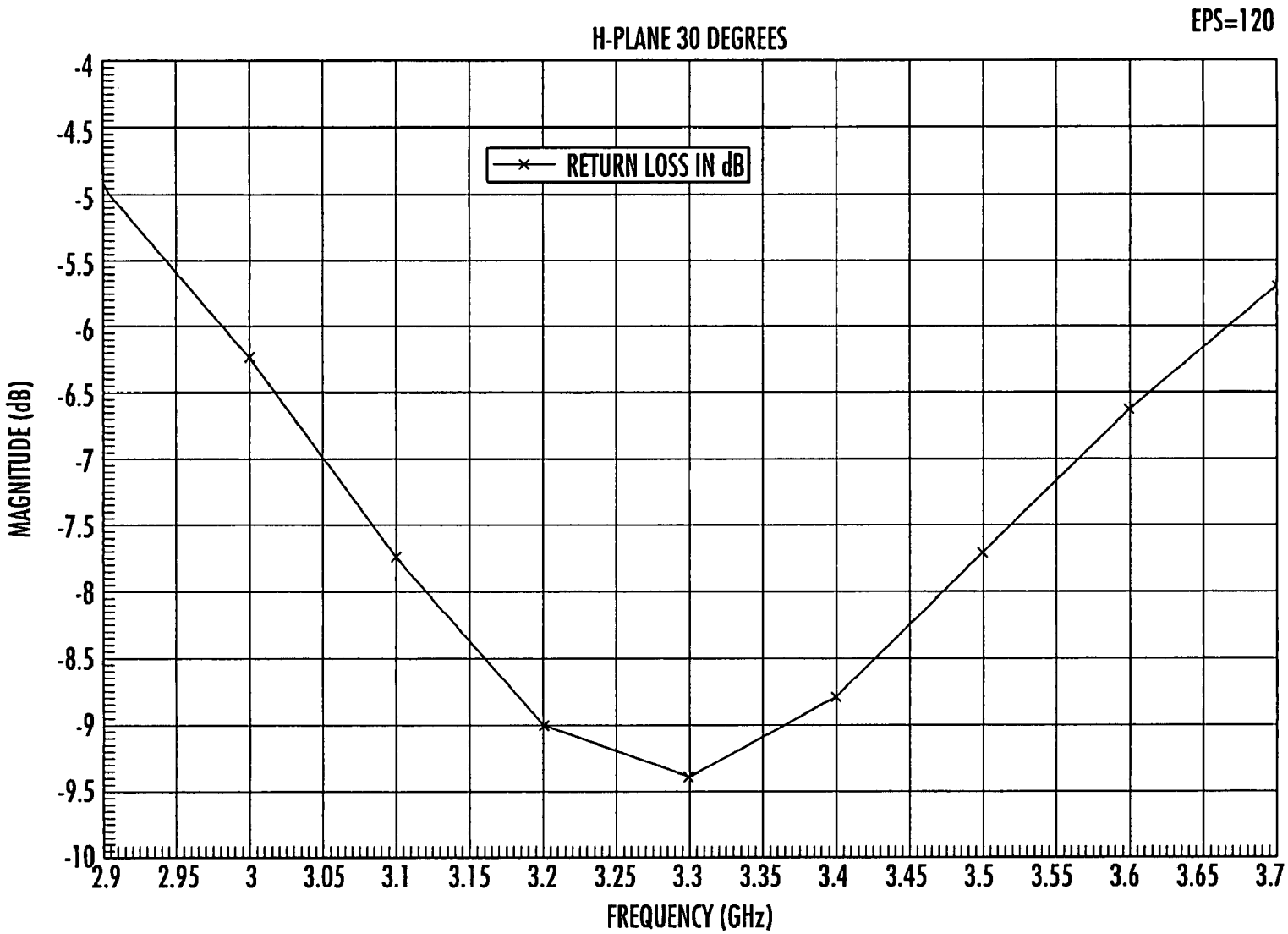
Figure 9D:
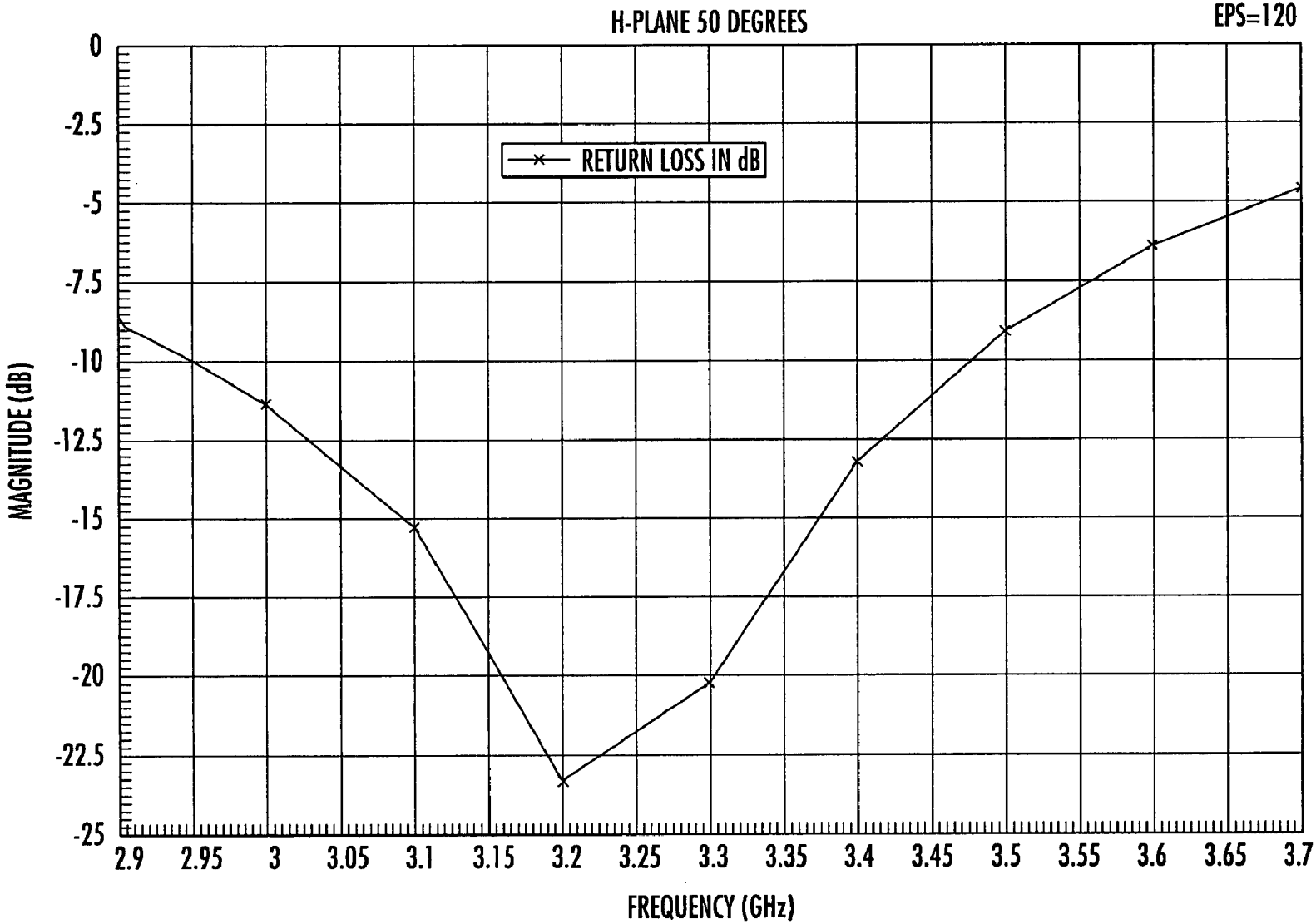
Figure 9E:
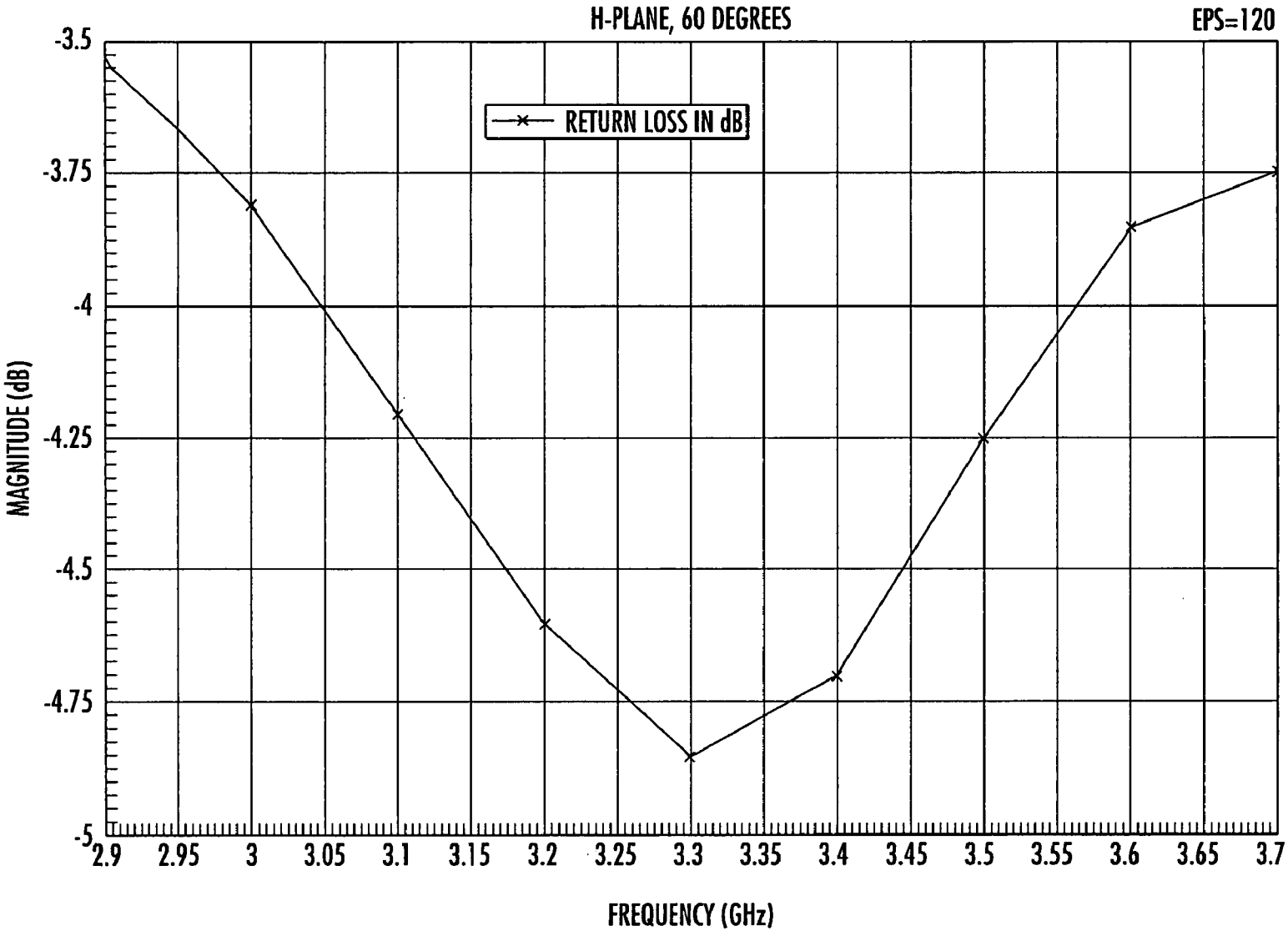

FIG. 9*a* is a return loss plot in dB of the array antenna of FIG. 7 over the frequency range of 2.9 to 3.7 GHz with the array arranged for boresight or broadside radiation (radiation in the z direction of FIG. 8). The return loss is below 6 dB over the range of about 3.2 to 3.65 GHz. FIG. 9*b* is a return loss plot in dB of the array antenna of FIG. 7 over the frequency range of 2.9 to 3.7 GHz with array scan angle depressed from the zenith by 50° in the yz (E) plane of FIG. 8. As illustrated, the return loss is less (better) than 15 dB over the frequency range of 3.05 to 3.3 GHz. FIG. 9*c* is a return loss plot in dB of the array antenna of FIG. 7 over the frequency range of 2.9 to 3.7 GHz with the array arranged for peak radiation 30° from the zenith in the xz (H) plane. As illustrated, the return loss is less (better) than 15 dB over the frequency range of 3.05 to 3.3 GHz. FIG. 9*d* is a return loss plot in dB of the array of FIG. 7 over the frequency range of 2.9 to 3.7 GHz, with the array arranged for peak radiation 50° from the zenith in the xz or H plane. FIG. 9*e* is a corresponding plot in the H plane at 60° from the zenith.

While the embodiments of the invention as described have had the feed end of the dielectric member physically or galvanically connected to the center conductor of an unbalanced transmission line, they may be coupled to the strip conductors of microstrip, stripline or tristrip transmission lines. While the dielectric monopole is illustrated as being of approximately of the same diameter or transverse dimension as the center conductor of the feed transmission line, the diameter of the dielectric element may be larger or smaller than the diameter of the center conductor.

An antenna (10) according to an aspect of the invention comprises an unbalanced transmission-line feed (14) defining center (14*c*) and outer (14*o*) conductors. An elongated dielectric or nonconductive member (16) defines first ($\mathbf{16}_1$) and second ($\mathbf{16}_2$) ends, and is curved between the first ($\mathbf{16}_1$) and second ($\mathbf{16}_2$) ends. The curvature in one embodiment is about 90°. The curvature may be defined by a radius (R). The first end ($\mathbf{16}_1$) of the dielectric member (16) is connected to the center conductor (14*c*) of the unbalanced transmission-line (14). According to an aspect of the invention, the dielectric constant of the dielectric member (16) exceeds 10, and preferably exceeds about 80. In one embodiment, the dielectric constant is 120.

An antenna (10) according to another aspect of the invention includes a ground plane (12) defining an aperture (12*a*) with a periphery, and an unbalanced transmission line (14) including an outer conductor (14*o*) coupled to the periphery of the aperture (12*a*), and also including a center conductor (14*c*). An elongated dielectric member (16) defines first ($\mathbf{16}_1$) and second ($\mathbf{16}_2$) ends, and is curved between the first ($\mathbf{16}_1$) and second ($\mathbf{16}_2$) ends. The dielectric member (16) is mounted with the first end ($\mathbf{16}_1$) of the dielectric member (16) in contact with the center conductor (14*c*), and with at least one of (a) a tangent to an axial centerline (18) of the dielectric member (16) adjacent the first end ($\mathbf{16}_1$) projecting generally orthogonally to the local surface of the ground plane (12) and (b) a tangent to an axial centerline (18) of the dielectric member (16) adjacent the second end ($\mathbf{16}_2$) of the dielectric member (16) generally parallel with the local surface of the ground plane (12). In one embodiment, the dielectric member (16) is a dielectric rod, which may have a generally circular cross-section orthogonal to the axial centerline (18) of the dielectric member. According to an aspect of the invention, the dielectric constant of the dielectric member is greater than 10. The dielectric constant is preferably greater than about 80, and in one embodiment the dielectric constant of the dielectric member is near 120.

According to another aspect of the invention, electrically conductive material (910) is applied to or formed on a dorsal portion of the exterior surface of the dielectric member (16). This electrically conductive material (910) may be in galvanic or direct electrical contact with the center conductor (14*c*).

According to another aspect of the invention, an array antenna (1000) comprises a ground plane (12) and first (10) and second (10) elemental antennas, each of which elemental antennas comprises an unbalanced transmission line (14) including an outer conductor (14*o*) coupled to the periphery of a corresponding aperture (12*a*) in the ground plane (12), and also comprises a center conductor (14*c*). Each of the elemental antennas (10) also includes an elongated dielectric member (16) defining first ($\mathbf{16}_1$) and second ($\mathbf{16}_2$) ends, with the dielectric member (16) being curved between the first ($\mathbf{16}_1$) and second ($\mathbf{16}_2$) ends. The curvature may be through an angle of 90°. Each elemental antenna (10) also has the dielectric member (16) mounted with the first end ($\mathbf{16}_1$) of the dielectric member in contact with the center conductor (14*c*), and with one of (a) a tangent to an axial centerline (18) of the dielectric member (16) adjacent the first end ($\mathbf{16}_1$) projecting generally orthogonally to the local surface of the ground plane (12) and (b) a tangent to an axial centerline (18) of the dielectric member (16) adjacent the second end ($\mathbf{16}_2$) generally parallel with the local surface of the ground plane (12). According to one version of this aspect of the invention, the dielectric constant of the dielectric member (16) of each of the elemental antennas (10) is greater than 10. According to another version, the dielectric constant of the dielectric member of each of the elemental antennas is greater than about 80, and preferably near 120. In another aspect of the invention, the dielectric constants of the dielectric members of the elemental antennas are approximately equal.

What is claimed is:

1. An antenna, comprising:

an unbalanced transmission-line feed defining center and outer conductors; and an elongated dielectric member defining first and second ends, said dielectric member being curved between said first and second ends, said first end of said dielectric member being physically, directly connected to said center conductor of said unbalanced transmission-line.

2. An antenna according to claim 1, wherein the dielectric constant of said dielectric member exceeds 10.

3. An antenna according to claim 2, wherein said dielectric constant of said dielectric member exceeds 100.

4. An antenna, comprising:

a ground plane defining an aperture with a periphery;

an unbalanced transmission line including an outer conductor coupled to said periphery, and also including a center conductor;

an elongated dielectric member defining first and second ends, said dielectric member being curved between said first and second ends; and said dielectric member being mounted with said first end of said dielectric member in contact with said center conductor, and with one of (a) a tangent to an axial centerline said dielectric member adjacent said first end projecting generally orthogonally to the local surface of said ground plane and (b) a tangent to an axial centerline of said dielectric member adjacent said second end generally parallel with the local surface of said ground plane.

5. An antenna according to claim 4, wherein said dielectric member is a dielectric rod.

6. An antenna according to claim 5, wherein said dielectric rod has a generally circular cross-section orthogonal to said axial centerline.

7. An antenna according to claim 4, wherein the dielectric constant of said dielectric member is greater than 10.

8. An antenna according to claim 7, wherein the dielectric constant of said dielectric member is greater than 100.

9. An antenna according to claim 8, wherein said dielectric constant of said dielectric member is near 120.

10. An array antenna, said array antenna comprising a ground plane and first and second elemental antennas, each of said elemental antennas comprising:

an unbalanced transmission line including an outer conductor coupled to the periphery of an aperture in said ground plane, and also including a center conductor;

an elongated dielectric member defining first and second ends, said dielectric member being curved between said first and second ends; and mounting means for mounting said dielectric member with said first end of said dielectric member in contact with said center conductor, and with one of (a) a tangent to an axial centerline said dielectric member adjacent said first end projecting generally orthogonally to the local surface of said ground plane and (b) a tangent to an axial centerline of said dielectric member adjacent said second end generally parallel with the local surface of said ground plane.

11. An array antenna according to claim 10, wherein the dielectric constant of said dielectric member of each of said elemental antennas is greater than 10.

12. An array antenna according to claim 11, wherein the dielectric constant of said dielectric member of each of said elemental antennas is greater than 100.

13. An array antenna according to claim 11, wherein the dielectric constants of said dielectric members of said elemental antennas are approximately equal.

14. An array antenna according to claim 10, wherein the dielectric constant of said dielectric member of each of said elemental antennas is approximately 120.

15. An antenna, comprising:

a ground plane defining an aperture with a periphery;

an unbalanced transmission line including an outer conductor coupled to said periphery, and also including a center conductor;

an elongated dielectric member defining first and second ends, said dielectric member being curved between said first and second ends, said dielectric member having a generally circular cross-section;

mounting means for mounting said dielectric member with said first end of said dielectric member in contact with said center conductor, and with one of (a) a tangent to an axial centerline of said dielectric member adjacent said first end projecting generally orthogonally to the local surface of said ground plane and (b) a tangent to an axial centerline of said dielectric member adjacent said second end generally parallel with the local surface of said ground plane; and an electrically conductive material applied to a dorsal portion of the exterior surface of said dielectric member.

16. An antenna according to claim 15, wherein said electrically conductive material is in galvanic contact with said center conductor.

* * * * *